United States Patent [19]

Nakajima et al.

[11] 4,291,402

[45] Sep. 22, 1981

[54] PLASTIC WATCH CASE

[75] Inventors: Koichi Nakajima; Hidetaka Tsuchiya, both of Tanashi, Japan

[73] Assignee: Citizen Watch Co., Ltd., Tokyo, Japan

[21] Appl. No.: 141,976

[22] Filed: Apr. 21, 1980

[30] Foreign Application Priority Data

May 25, 1979 [JP] Japan ..... 54-69586[U]

[51] Int. Cl.[3] ..... G04B 37/00

[52] U.S. Cl. ..... 368/276; 368/294; 368/295; 368/296; 368/292

[58] Field of Search ..... 368/276, 294–296, 368/291, 292, 88, 300, 281

[56] References Cited

U.S. PATENT DOCUMENTS 3,789,606 11/1972 Isono ..... 368/294

*Primary Examiner*—Ulysses Weldon

*Attorney, Agent, or Firm*—Birch, Stewart, Kolasch & Birch

[57] ABSTRACT

A glass mounting structure for watches comprises a watch case made of plastic having an opening for the glass. A flange member made of metal plate is embedded in the watch case surrounding the opening. The flange has an inside flange portion which laterally extends into the opening for supporting the glass.

6 Claims, 7 Drawing Figures

PLASTIC WATCH CASE

BACKGROUND OF THE INVENTION

The present invention relates to a watch case made of plastic.

In recent years, wristwatches have been available having multiple functions such as an alarm, calculator and timer. In such a watch, a plurality of push buttons are provided for performing such functions. Accordingly, a case for such a watch must have a plurality of holes for push buttons and a flange for supporting a piece of glass. In a watch case made of metal, such holes and flange are formed by cutting. However, it is difficult to form with accuracy a plurality of holes and a flange, especially a flange for a non-circular piece of glass. On the other hand, a plastic watch case can be easily made by molding. However, the flange must be made to have a sufficient thickness to support the glass. Therefore, the thickness of the watch case is increased, which is of course undesirable.

SUMMARY OF THE INVENTION

It is an object of the present invention to provide a watch case made of plastic which may be decreased in thickness.

Another object of the present invention is to provide a glass mounting flange structure which may be formed with accuracy.

According to the present invention, there is provided a glass mounting structure for watches comprising a watch case made of plastic, said watch case having an opening for the glass, a flange member made of metal plate embedded in the glass mounting portion of the watch case surrounding said opening, said flange member comprising an axially extending annular wall portion and an inside flange portion which laterally projected into said opening, and a packing inserted in the space between the periphery of said glass and the inside wall of said opening.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
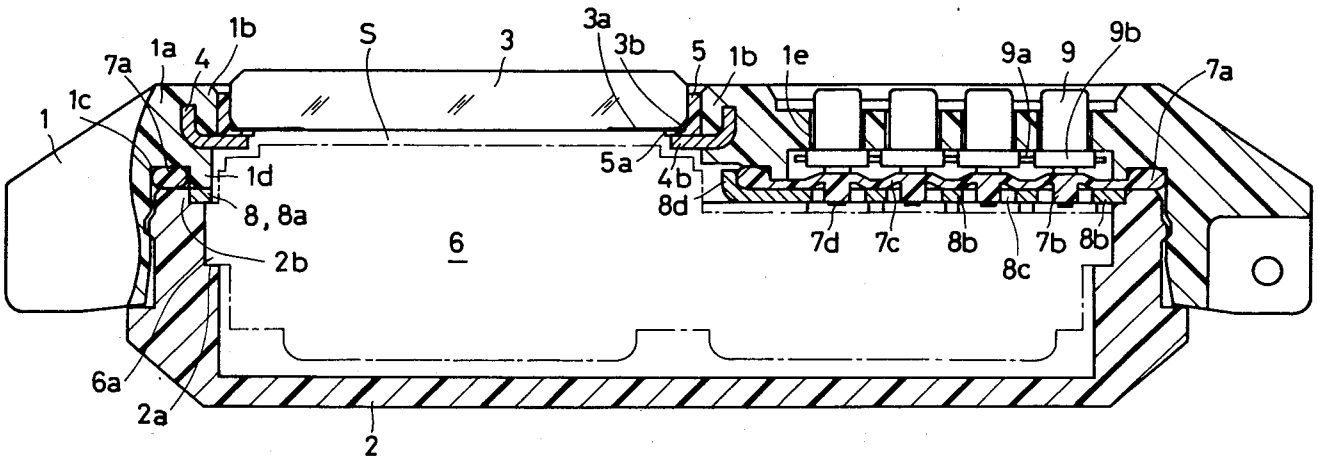
FIG. 1 is a sectional view of a wristwatch case according to the present invention.
Figure 2:
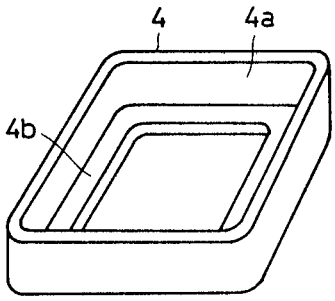
FIGS. 2 and 3 are perspective views showing examples of a metal flange.

Referring to the drawings and more particularly to FIG. 1, numeral 1 designates a wristwatch case made of plastic, having a back 2 constructed of plastic in the same manner as the case 1. A glass 3 includes printings 3*a* and a beveled guiding portion 3*b*, and a flange member 4 is made of metal plate.

The case 1 is formed by molding the plastic such as polycarbonate resin, acrylic resin or acrylonitrile butasien styrene. The case has an opening for the glass and a glass mounting portion 1*a* surrounding the opening in which the flange member 4 is embedded by the insert molding method, so that an inside wall portion 1*b* may be formed. The flange member 4 comprises an axially extending annular wall portion 4*a* and a lateral inside flange portion 4*b*. The annular wall 4*a* serves to limit the contraction of the molded plastic, whereby the inside wall portion 1*b* having accurate inner dimensions may be formed. The inside flange portion 4*b* and the inside wall portion 1*b* form a recess for mounting the glass. A packing member 5 is engaged with the glass mounting recess and the glass 3 is mounted in the packing. The packing 5 has a laterally extending seat portion 5*a* for preventing the glass from contacting with the metal flange 4*b*.

Since the flange portion 4*b* is a thin metal plate, the space "S" between the glass 3 and module 6 may be reduced in thickness.

Figure 3:
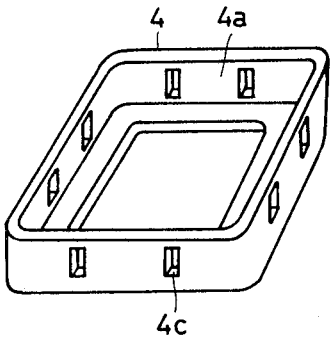

FIG. 3 shows another example of the flange member 4. The flange member has a plurality of holes 4*c* in the annular wall portion 4*a*. Since plastic engages with the holes 4*c*, deflection of the plastic in a circumferential direction which will occur during the curing of the molded plastic may be prevented.

Thus, the glass mounting portion may be formed with accuracy and even a non-circular piece of glass may be mounted with watertight sealing.

The case 1 has an annular groove 1*c* with which a peripheral sealing portion 7*a* of a sealing rubber 7 is engaged. The case 1 and the back 2 are in watertight engagement with each other by a snap engagement through the peripheral sealing portion 7*a*. A reinforcement member 8 is provided between the module 6 supported on the shoulder 2*a* of the back 2 and the projection 1*d* of the case 1.

Figure 5:
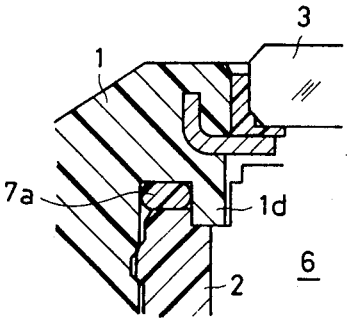
FIG. 5 is a sectional view showing a part of another embodiment of the present invention.
Figure 4:
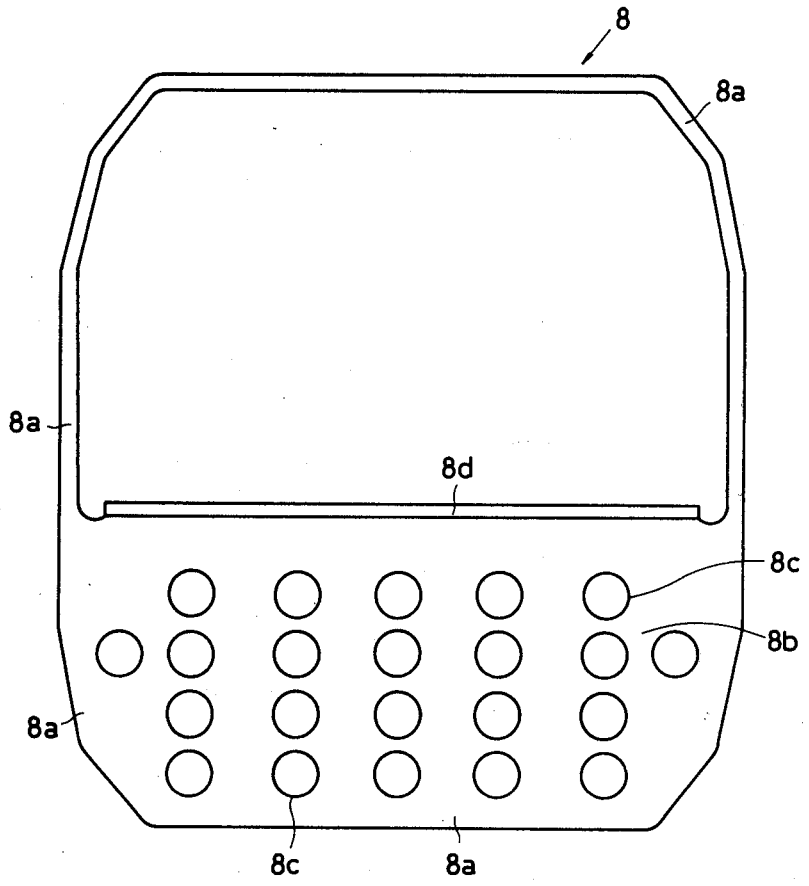
FIG. 4 is a plan view of a reinforcement member.
Figure 6A:
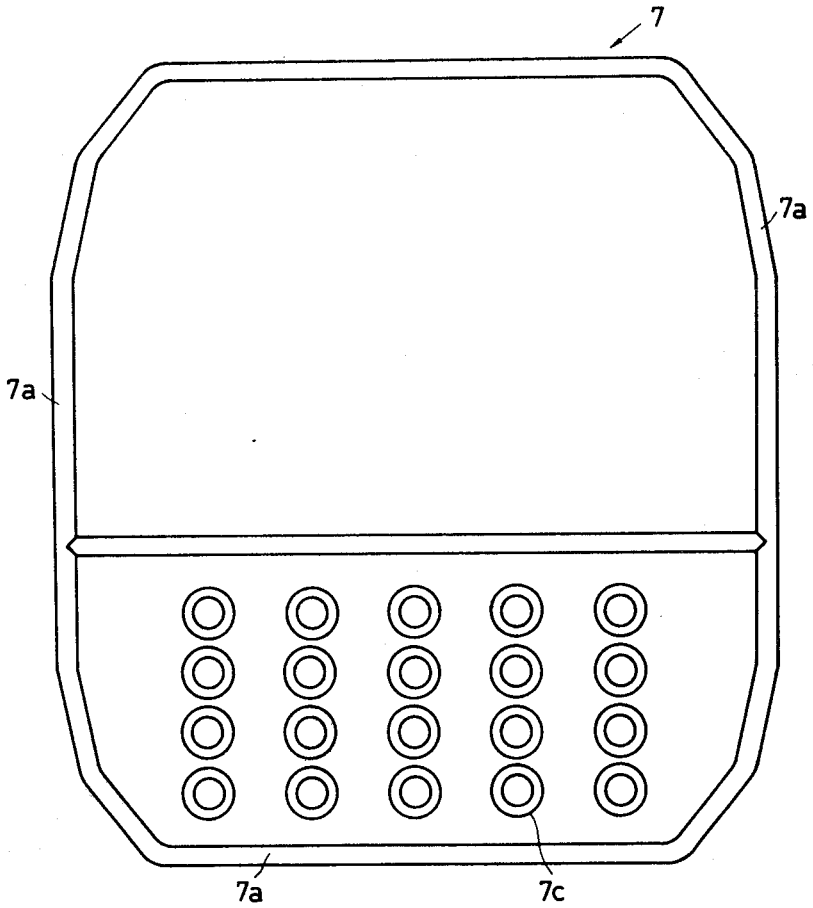
FIG. 6*a* is a plan view of a sealing rubber.
Figure 6B:
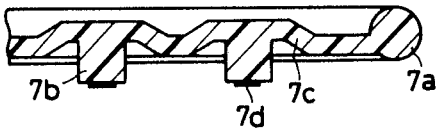
FIG. 6*b* is a sectional view of a part of the sealing rubber.

The reinforcement member 8 is made of metal plate and comprises a peripheral portion 8*a*, a supporting portion 8*b*, and a plurality of holes 8*c*. The peripheral portion 8*a* is disposed between the projection 1*d* and the module 6 and a shoulder 2*b* of the back 2, so that the sealing rubber 7 may be compressed at a certain pressure. It will be understood that the reinforcement member 8 may be omitted. FIG. 5 shows a part of such an example wherein the projection 1*d* abuts on the back 2 and adjacent to the module 6.

The case 1 has a plurality of holes 1*e* for a plurality of push buttons. Each push button 9 comprises a body and a flange 9*b* to prevent the remove of the button from the case. Each push button is connected to adjacent push buttons by resilient connecting branches 9*a*, that is all push buttons are connected with each other by the resilient connecting branches 9*a*. The push button assembly is made by the integral molding of plastic. The lower end of each push button body abuts on a protrusion 7*c* provided in the sealing rubber 7 for each push button body. On the underside of each protrusion 7*c* is an integrally formed contact projection 7*b* having a printed contact 7*d* at the lower end surface. The sealing rubber 7 is supported by the supporting portion 8*b* of the reinforcement member 8 and each contact projection 7*b* extends through the hole 8*c*. An end portion of the sealing rubber 7 is engaged with a bent edge 8*d* to provide a watertight sealing.

In accordance with the present invention, since the flange member 4 is embedded in the glass mounting portion 1*a*, contraction of the molded plastic may be prevented. Therefore, the recess for mounting the glass may be formed with accuracy and hence the glass may be mounted with watertight sealing. Further, since the flange is made of thin metal plate, the space between the glass and the module may be reduced for providing a thin watch.

What is claimed is:

1. A glass mounting structure for watches comprising a watch case made of plastic, said watch case having an opening, a flange member made of metal plate embedded in a portion of said watch case surrounding said opening, said flange member comprising an axially extending annular wall portion embedded in said watch case along an inside wall of said opening and an inside flange portion which is laterally projected into said opening, a packing engaged in the inside wall of said opening and a glass engaged on an inner side of said packing and supported by said flange portion.

2. A glass mounting structure according to claim 1 in which said packing has a laterally extending seat portion for preventing the contact of the glass to the inside flange portion of the flange member.

3. A plastic watch case comprising:

a plastic back member including outwardly projecting side walls defining a cavity adapted to receive a watch module, said side walls terminating to define a continuous shoulder portion;

a plastic case member including an enlarged open portion and a plurality of additional openings, said plastic case member being adapted to mate with said shoulder portion of said plastic back member to provide a closure thereto;

a flange member made of metal plate being embedded in a portion of said plastic case member surrounding said enlarged open portion, said flange member comprising an axially extending annular wall portion embedded in said case member along an inside wall of said enlarged open portion and an inside flange portion laterally projecting into said opening;

a packing engaged in the inside wall of said enlarged open portion; and a glass member engaged on an inner side of said packing and being supported by said flange portion.

4. A plastic watch case according to claim 3, and further including a reinforcement member operatively positioned on said continuous shoulder portion.

5. A plastic watch case according to claim 3 or 4, wherein a sealing member is operatively disposed between said continuous shoulder portion and said case member.

6. A plastic watch case according to claim 3, and further including a plurality of push buttons operatively disposed within said plurality of additional openings within said plastic case member, said plurality of push buttons being selectively engagable to operate said watch module.

* * * * *